United States Patent [19]

Bradley et al.

[11] 4,298,115

[45] Nov. 3, 1981

[54] TIME-LAPSE INDICATOR

[75] Inventors: Robert F. Bradley; Lindell P. Bradley, both of New Buffalo, Mich.

[73] Assignee: Micro-Circuits Company, New Buffalo, Mich.

[21] Appl. No.: 10,688

[22] Filed: Feb. 9, 1979

[51] Int. Cl.[3] ..... G04F 13/00; G07F 9/02

[52] U.S. Cl. ..... 194/4 F; 116/308

[58] Field of Search ..... 116/308, 206, 207; 368/327, 114, 107, 89; 324/71 R, 65 R; 194/4 F, DIG. 18; 338/223, 114

[56] References Cited

U.S. PATENT DOCUMENTS

| | | | |
|---|---|---|---|
| 2,589,983 | 3/1952 | Blodgett et al. | 73/337 X |
| 2,626,381 | 1/1953 | Olson | 324/65 R |
| 2,746,745 | 5/1956 | Damon | 194/DIG. 23 |
| 2,917,814 | 12/1959 | Ruckelshaus | 324/182 X |
| 3,045,179 | 7/1962 | Maier | 368/114 |
| 3,046,786 | 7/1962 | Tessem | 204/195 R X |
| 3,273,683 | 9/1966 | Goodman | 194/DIG. 23 |
| 3,295,088 | 12/1966 | Smith | 324/65 R |
| 3,479,864 | 11/1969 | Patterson | 73/64.3 |
| 3,480,402 | 11/1969 | Jackson | 58/1 R |
| 3,510,263 | 5/1970 | Hack | 422/56 X |
| 3,511,608 | 5/1970 | Anderson | 422/56 |
| 3,520,124 | 7/1970 | Myers | 116/206 X |
| 3,539,470 | 11/1970 | Icre | 338/38 X |
| 3,581,703 | 6/1971 | Hosack | 116/206 X |
| 3,603,880 | 9/1971 | Brecker, Jr. et al. | 368/114 |
| 3,620,677 | 11/1971 | Morison | 116/200 |
| 3,679,978 | 7/1972 | Ogawa et al. | 324/182 |
| 3,839,857 | 10/1974 | Berets et al. | 368/82 |
| 3,954,011 | 5/1976 | Mamske | 368/327 X |
| 3,998,307 | 12/1976 | Volben et al. | 194/4 R |
| 4,057,029 | 11/1977 | Seiter | 73/356 X |
| 4,086,475 | 4/1978 | Churchill | 340/51 |
| 4,100,490 | 7/1978 | Peck et al. | 368/114 |
| 4,125,822 | 11/1978 | Perren et al. | 324/65 R X |
| 4,206,838 | 6/1980 | Bradley | 116/308 |
| 4,229,813 | 10/1980 | Lilly et al. | 116/206 X |

*Primary Examiner*—Daniel M. Yasich

*Attorney, Agent, or Firm*—Marmaduke A. Hobbs

[57] ABSTRACT

A time-lapse indicator in which an electrically conducting, fluid-absorbent layer is initially separated from an activating fluid. When the indicator is activated the fluid flows into the absorbent layer, thereby changing the electrical conductivity of the absorbent layer. The fluid may be retained by a receptacle having a rupturable wall portion in a layer paralleling said absorbent layer and the rupturable wall portion may be a frangible layer between the liquid and the absorbent layer, which is broken when the indicator is activated. A time delay layer may also be included between the frangible layer and the absorbent layer to control the rate of flow of the liquid into the absorbent layer and thereby prolong the effective operation of the indicator following activation thereof.

21 Claims, 7 Drawing Figures

Fig. 1
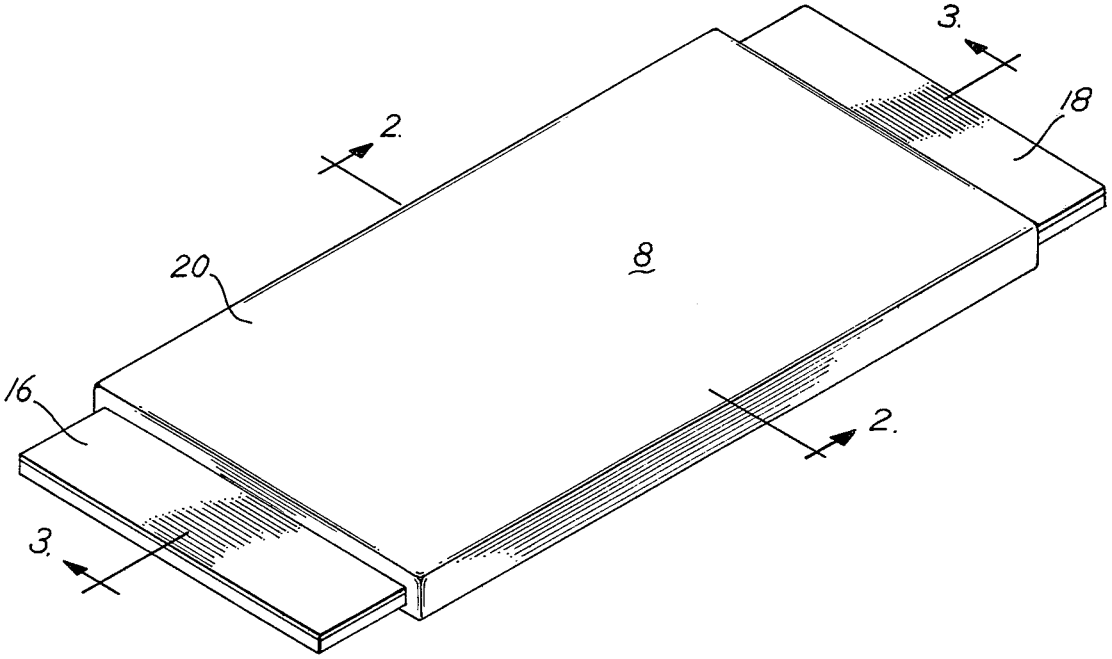
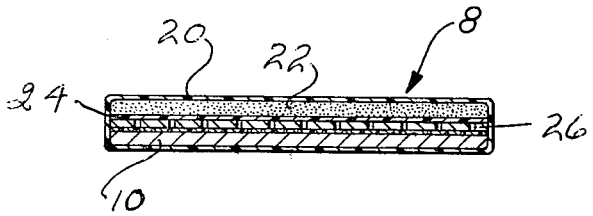
Fig. 2

Fig. 3
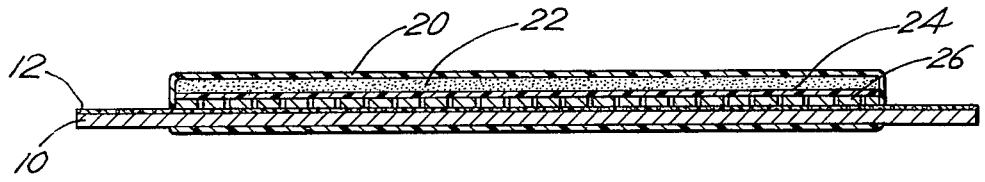
Fig. 4
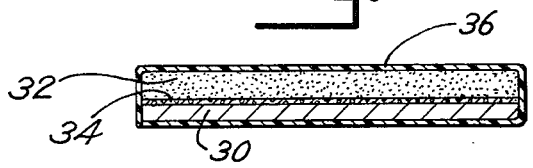
Fig. 5
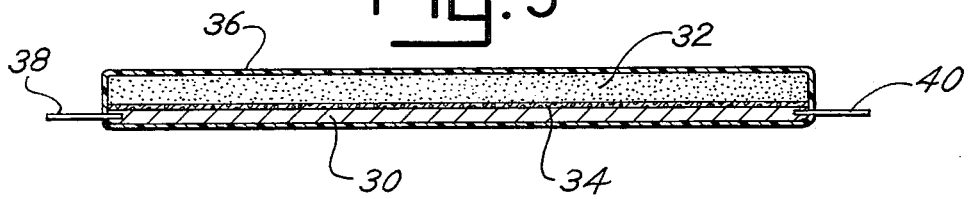
Fig. 6
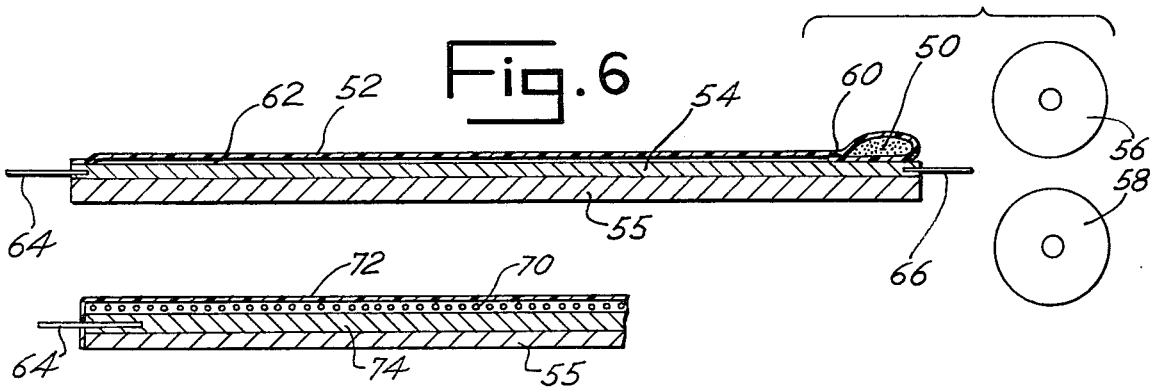
Fig. 7

TIME-LAPSE INDICATOR

Cards, tickets and the like are extensively used for unattended parking lots at airports, college campuses and in urban areas, and no satisfactory way has been used in the past which will automatically read the card to determine the time the lot was used by the customer, and indicate the amount due so that the customer can pay as he leaves the lot. Thus, an attendant must be on hand either continually or periodically to check and/or collect the amount due. This same problem or difficulty exists in a variety of different enterprises such as unattended movies, rental of golf carts and other vehicles, toll roads, and amusement and recreational facilities. In the use of these enterprises and facilities, most people are honest and are willing to pay the correct amount on the basis of time used; however, there has not been a satisfactory way for the user to be adequately apprised of the amount due without the presence of an attendant to determine and collect the amount due. It is therefore one of the principal objects of the present invention to provide a card, ticket or device which can be taken by a customer as he enters a parking lot or other establishment, and which automatically changes in a manner which permits a machine or system to read the card, ticket or device to sense the time the lot or other facility has been in use and to indicate to the customer the amount due so that the customer can deposit the amount on leaving.

Another object of the invention is to provide a time-lapse card or the like which can be activated at a given time and under preselected conditions to record the time thereafter until the card is read by a machine or system to indicate the lapsed time and convert the time into readable information.

In addition to the use of the card for parking lots and other establishments and facilities mentioned above, the card, envelope, label or similar device can be used to indicate the condition of perishable commodities, such as milk, meat, eggs, orange juice and medicines and many other products and things. In connection with these additional uses, it is an object of the invention to provide an indicator which is responsive to one or more physical factors, such as pressure, humidity, temperature, gravity, time, and/or other physical forces, so that various sensed conditions of the products will be accurately reflected by the indicator when read or tested in practice.

Still another object of the invention is to provide a relatively simple time-lapse card or similar device which can easily be dispensed, carried and read, and which can be so constructed and designed that it can be used to sense only a short period of time, or long periods of time, or both, so that it can be used to indicate time-lapse of less than an hour or several weeks or longer, thus being readily adaptable to different types of rental or parking periods.

Further objects and advantages of the present invention will become apparent from the following description and accompanying drawings wherein:

FIG. 1 is a perspective view of an indicator embodying one form of the invention;

FIG. 2 is an enlarged transverse cross sectional view of the indicator shown in FIG. 1, the section being taken on line 2—2 of the latter figure;

FIG. 3 is an enlarged longitudinal cross sectional view of the indicator shown in the preceding figures, the section being taken on line 3—3 of FIG. 1;

FIG. 4 is a cross sectional view of an indicator similar to that shown in FIG. 2, but illustrating a modified form of the present invention;

FIG. 5 is a longitudinal cross sectional view similar to that shown in FIG. 3, but illustrating the embodiment of the invention shown in FIG. 4;

FIG. 6 is a modified form of the present invention illustrating the manner in which the form shown can be activated; and FIG. 7 is a still further modified form of the present invention illustrating the manner in which the form shown can be activated.

Referring more specifically to the drawings, FIG. 1 illustrates one embodiment of the present invention, the particular one shown being a ticket such as that used at a parking lot or the like. The indicator 8 may vary over a wide range of sizes and shapes and can effectively be adapted to various dispensing and reading machines such as those illustrated in U.S. Pat. No. 4,206,838 issued to Robert F. Bradley. The embodiment of the invention illustrated in FIGS. 1, 2 and 3 consists of a base 10 of any suitable, preferably nonporous, material, and preferably of sufficient rigidity or stiffness that the indicator is not readily flexed but will retain its substantially flat form as illustrated in FIG. 1.

A layer of absorbent material 12 is applied to the upper surface of base 10, as seen in FIG. 3, and may be of any one of a variety of different materials which will absorb fluid either instantaneously or at a controlled rate. A vinyl butyral resin for example, may be used for layer 12, and the layer is impregnated with a material which renders the layer electrically conductive. A suitable material used for this purpose is silver powder which is evenly distributed throughout the layer. This resin impregnated with the silver powder will effectively conduct a current, and the contacts may be made at the extended ends 16 and 18 which project beyond an envelope 20. A layer 22 of paste or carrier containing a nonconductive fluid is disposed in the envelope and is initially separated from absorbent layer 12 by an impervious layer 24. Thus the fluid containing paste, or fluid alone, is enclosed in the envelope and is prevented by layer 24 from reaching the absorbent layer. The layer 24 is of frangible material such as a brittle plastic which can be easily broken or punctured to permit the fluid from the paste to flow therethrough.

In order to provide a controlled flow of fluid from the paste into absorbent layer 12, a retarding layer 26 may be interposed between layer 24 and the absorbent layer. This may be a plastic layer with perforations, or it may be a nonconductive absorbent material which permits the fluid to migrate slowly therethrough at a predetermined rate. The layers 10, 12, 22, 24 and 26 are enclosed in envelope 20, which is preferably a plastic material with some flexibility, i.e. not brittle or rigid, and the side edges thereof are sealed along the protruding surfaces of base 10 and absorbent layer 12 to prevent the fluid in the paste from seeping from the indicator, either before or after the frangible layer has been ruptured.

In the use and operation of the indicator shown in FIGS. 1, 2 and 3, frangible layer 24 is broken by any suitable means or mechanism, such as the dispenser machine shown in the abovementioned patent. This permits the fluid in the paste in layer 22 to contact retarding layer 26 and gradually pass therethrough at a controlled rate to the absorbent material where it tends to separate the particles of silver powder by causing the material to swell, by forming a resistant coating around the particles, or otherwise to decrease the conductivity of absorbent layer 12. The fluid from the paste increases the resistance at the point where it is absorbed by layer 12, and hence increases the resistance between the two electrodes 16 and 18. The increase in resistance can readily be determined by an ohmmeter or any suitable electronic device for reading the variations in resistance. This variation in resistance is then translated into readable or other usable results, such as the amount of money required for the time since the ticket was activated by rupturing the frangible layer.

In order to effectively activate the indicator, it is only necessary to puncture the frangible layer at any one point, preferably substantially across the layer in the transverse direction with respect to the flow of current between the two electrodes. The flow is controlled by the retarding layer 26 and the rate at which the fluid can be absorbed in the absorbent layer 12.

The embodiment illustrated in FIGS. 4 and 5 is essentially the same as that shown in FIGS. 1, 2 and 3, except the retarding layer 26 of the previous embodiment has been omitted. In the embodiment shown in FIGS. 4 and 5, which is essentially a simplified form of the concept previously described, the absorbent conductive layer 30 and the layer of paste 32 are separated by a frangible layer 34. The layers are enclosed in a plastic envelope 36, and electrodes 38 and 40 are in contact with absorbent layer 30. The operation of the indicator is essentially the same as the embodiment previously described except that, when the frangible layer is punctured or otherwise broken, the fluid from the paste flows through the crevices in the frangible layer into the absorbent material and, as previously described, causes the resistance of the absorbent layer containing silver powder or other suitable conductive material to increase at a predetermined rate, thereby permitting the indicator to be used to determine the time between activation and reading of the indicator. The materials forming the structure of the embodiment of FIGS. 4 and 5 are essentially the same as the layers of the embodiments of FIGS. 1, 2 and 3.

In the modified form illustrated in FIG. 6, instead of providing a layer of paste coextensive with the frangible layer, a closed pouch 50 is disposed at one end of envelope 52 and an absorbent layer 54, and is sealed in the envelope, the absorbent layer being mounted on base layer 55. When the indicator is to be activated, it is passed through rollers 56 and 58 which apply sufficient pressure to pouch 50 to rupture the pouch along the line indicated by numeral 60, thereby permitting the paste or other fluid material to flow into space 62 and into contact with the absorbent layer 54. The flowing of the fluid into the absorbent layer increases the resistance of the layer and decreases the flow of current between the electrodes 64 and 66, thus permitting the indicator to be used to determine the period of time from activation to the reading of the indicator, in the manner previously described herein and in the aforementioned co-pending application.

In the further modified form illustrated in FIG. 7 the paste or fluid material is enclosed in very small rupturable spheres or beads 70. A layer of these beads is positioned between envelope 72 and absorbent layer 74 and sealed in the envelope. This modified form may be activated in a manner similar to that explained in FIG. 6. A further modification of this form has the beads dispersed within absorbent layer 74 and ruptured in a manner similar to that just described. When the beads are ruptured, the fluid then is absorbed by the absorbent layer as the timing cycle begins. Increased resistance results from increased time and as previously described the increased resistance can be used to determine the length of time after activation of the indicator.

Frangible layer 24 and pouch 50 may be of a variety of different materials but normally will consist of plastic which will not react to the paste or fluid, and which will rupture as required to expose the absorbent layer 12 or 54. The conductive layer of particulated material is normally in the form of a dry film before it is subjected to the fluid in the paste, and the binder for the particulated material, such as the silver powder, is a resin or other material which will become swollen or will be dissolved by the fluid carrier, resulting in the separation of the conductive particles and thus an increase in the resistance of the absorbent layer. The increase in resistance may be made slower and substantially linear by using a relatively thick layer of conductive material and/or by using a fluid which acts upon it relatively slowly. The change can be made relatively abrupt by using a thin layer of conductive material and/or a more active carrier. The onset of the increase in resistance as in the first embodiment described herein, is delayed by interposing a retarding barrier 26 which must be penetrated by the fluid from the paste before it penetrates the conductive layer. The frangible layer, which serves as a storage barrier, permits retention of the paste until the frangible layer is broken, crushed, melted, dissolved, punctured, removed, or otherwise modified so that it no longer blocks the movement of the fluid from the paste through the retarding layer 26 to the absorbent material as described with reference to FIGS. 2 and 3, or directly from the paste to the absorbent material, as described with reference to FIGS. 4 and 5. Typically, the layers 12 and 26 would be from two to five mils, depending upon the delay or timing period desired.

One example of the composition of layer 12 sensitive to the active fluid in the paste, consists of three grams of vinyl butyral resin and 20 grams of silver flake of 325 mesh size. This initially can be applied by an ethyl alcohol solution, and the layer may be formed by spraying several thin layers with an air brush. The terminals 16 and 18 may be silver paint applied to the exposed ends of layer 12. The timing barrier may be of various materials which permit a predetermined rate of flow of the fluid to the absorbent electrical conductor layer 12, an example consisting of 10 grams of a hard resin (Nevchem 140), 2 grams of carbon black and 20 grams of naphtha. Various combinations of materials can be used and a fluid can be used in place of the paste. Cresyl diphenyl phosphate is a liquid which works well for short timing periods and butyl benzyl phthalate works well for longer timing cycles. Either may be converted to a stiff paste by adding up to 5% of fumed silica. The fluid may initially exist as a solid in its stored form which is melted by a heater or laser or the like upon activation of the timer. The fluidified solid may in turn melt beads as previously described containing chemicals to maintain fluidity. The paste is nevertheless preferred, since it provides easier handling characteristics. The composition of the fluids in any of the described embodiments may be such as to make the fluids, and therefore the timer, responsive to various physical conditions. The paste, for example, may be designed to fluidify at particular temperatures and to solidify at colder temperatures. In this way the timer can be used to calculate time periods in which temperatures exceed specified limits. This is particularly useful for shelf-life calculation of perishable goods such as milk, eggs and the like where storage temperatures are critical. Further, the concept disclosed herein is adaptable to a magnetic readable indicator in much the same manner as that described in my previously mentioned patent, and the term electrical conductivity as used in the claims is intended to cover the magnetic embodiment of the present invention. External electrodes are not needed if conductivity is read electromagnetically or capacitively or if a magnetic layer is read by one of several kinds of magnetic sensing heads such as those which read magnetic characters on conventional bank checks.

In a modified form of the present invention, the fluid either as a paste or as a fluid alone, may be one which enhances the conductivity of the absorbent layer when the frangible portion of the receptacle in which the fluid is contained is broken and the fluid is transmitted to the absorbent layer. A liquid, either as such or as a component of a paste, containing sodium chloride changes the absorbent material from a virtually nonconducting layer to a conductive layer and the flow of the salt solution can be activated and controlled in the same manner as described hereinbefore with reference to the other embodiments described, such as, for example, the use of a receptacle with a frangible wall portion for the salt solution, and the use of a time delay layer between the frangible layer and the absorbent layer. Other salts or materials may be used in the fluid or different conductive fluids may be used to vary the flow of the current as the fluid is absorbed in the absorbent layer, thereby providing a means for determining the time lapse following activation of the indicator.

An example of a construction which permits very long timing periods with a relatively simple starting method is one in which a pinhole made in the storage barrier permits a very small area of contact between the paste and a layer of thin paper or other porous timing material. The timer is enclosed in a flexible puncture-proof envelope, while a puncturable layer such as paper or aluminum foil is placed between the fluid layer and the absorbent layer. When the timer is to be activated a blunt instrument is pressed on the outside of the timer, which will not puncture the outer envelope but will puncture the paper or foil barrier. The liquid migrating through the pinhole must then flow laterally through the paper for some distance to reach a path of sensitive conductive material printed or painted on the surface of the porous paper. Once the liquid reaches the nearest edge of the conductive layer the time required to completely destroy its conductivity will depend upon its width. Applying pressure to the paste area, to the sensitive conductive area, or to both affects the speed of migration of the fluid and the timing rate. Depending upon the materials, construction, and relative saturations the pressure may be used to speed up, stop, retard, or reverse the timing rate.

While several embodiments of the present time lapse indicator have been described in detail herein, various other changes and modifications may be made without departing from the scope of the invention.

We claim:

1. A time-lapse indicator comprising a layer of fluid-absorbent material, a particulated electrically conductive material disposed in said fluid-absorbent layer for rendering said layer electrically conductive, a means for holding a fluid in close proximity to said absorbent layer, a fluid migrating at substantially a predetermined rate to said absorbent layer from said holding means, said fluid when absorbed by said absorbent layer varying the conductivity of the absorbent layer in proportion to the degree of absorption of the fluid by the absorbent layer, with the degree of change in conductivity of said absorbent layer being related to the time duration of exposure of said fluid absorbent layer to said fluid to determine the time-lapse following commencement of the fluid transmittal, and a rupturable barrier means separating said fluid from said absorbent layer until said indicator is activated.

2. A time-lapse indicator as defined in claim 1 in which a retarding layer is disposed between said fluid and said absorbent layer for controlling the migration of fluid to said absorbent layer at the predetermined rate.

3. A time-lapse indicator as defined in claim 2 in which said fluid exists as a solid in its stored and unactivated form and fluidifies upon commencement of a timing cycle.

4. A time-lapse indicator as defined in claim 2 in which droplets of said fluid are encased in rupturable beads and said rupturable beads are positioned in a layer parallel to said retarding layer.

5. A time-lapse indicator as defined in claim 1 in which a receptacle contains said fluid in a layer parallel with said absorbent layer, and the rupturable barrier means is a frangible layer separating said fluid layer from said absorbent layer.

6. A time-lapse indicator as defined in claim 5 in which an envelope substantially encloses said layers.

7. A time-lapse indicator as defined in claim 5 in which a porous retarding layer is disposed between said fluid layer and said absorbent layer.

8. A time-lapse indicator as defined in claim 6 in which a porous retarding layer is disposed between said fluid layer and said absorbent layer.

9. A time-lapse indicator as defined in claim 8 in which said particulate material is silver powder.

10. A time-lapse indicator as defined in claim 6 in which said envelope is flexible and puncture-proof and said frangible layer may be punctured by the depression of a blunt instrument on the surface of said indicator.

11. A time-lapse indicator as defined in claim 1 in which said fluid absorbent layer has spaced electrodes thereon for passing a current through said layer between said electrodes, and said current is used to measure the conductivity of said absorbent layer.

12. A time-lapse indicator as defined in claim 1 in which said particulate material is silver powder.

13. A time-lapse indicator as defined in claim 1 in which said fluid exists as a solid in its stored and unactivated form and fluidifies upon commencement of a timing cycle.

14. A time-lapse indicator as defined in claim 1 in which said fluid is conductive and as it is absorbed by said absorbent layer enhances the conductivity of said layer.

15. A time-lapse indicator as defined in claim 14 in which said rupturable barrier means is a relatively brittle frangible layer separating said fluid layer from said absorbent layer.

16. A time-lapse indicator as defined in claim 15 in which a retarding layer is disposed between said frangible layer and said absorbent layer to assist in controlling the migration of said conductive fluid to said absorbent layer at the predetermined rate.

17. A time-lapse indicator as defined in claim 1 in which droplets of said fluid are encased in rupturable beads, and said rupturable beads are positioned in a layer parallel to said absorbent layer.

18. A time-lapse indicator as defined in claim 1 in which droplets of said fluid are encased in rupturable beads, and said rupturable beads are dispersed throughout said absorbent layer.

19. A time-lapse indicator as defined in claim 1 in which said fluid is retained in a receptacle having a rupturable portion and said rupturable portion consists of a frangible layer between said fluid and said absorbent layer.

20. A time-lapse indicator as defined in claim 19 in which a retarding layer is disposed between said frangible layer and said fluid absorbent layer to control the rate of migration of the fluid to said absorbent layer at the predetermined rate.

21. A time-lapse indicator as defined in claim 19 in which said receptacle is disposed along one edge of said indicator, and said fluid is forced out of said receptacle and flows over said absorbent layer upon activation of said indicator.

* * * * *